US011407223B2

(12) United States Patent
Teshima

(10) Patent No.: US 11,407,223 B2
(45) Date of Patent: Aug. 9, 2022

(54) LIQUID EJECTION HEAD, METHOD OF MANUFACTURING THE SAME, AND LIQUID EJECTION APPARATUS

(71) Applicant: CANON KABUSHIKI KAISHA, Tokyo (JP)

(72) Inventor: Takayuki Teshima, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 30 days.

(21) Appl. No.: 17/024,352

(22) Filed: Sep. 17, 2020

(65) Prior Publication Data

US 2021/0078323 A1 Mar. 18, 2021

(30) Foreign Application Priority Data

Sep. 18, 2019 (JP) ..... JP2019-169002

(51) Int. Cl.
*B41J 2/14* (2006.01)
*B41J 2/165* (2006.01)

(52) U.S. Cl.
CPC ..... *B41J 2/14* (2013.01); *B41J 2/16535* (2013.01); *B41J 2002/14491* (2013.01)

(58) Field of Classification Search
CPC ..... B41J 2/14129; B41J 2/14072; B41J 2/14427; B41J 2002/14491; B41J 2202/03; B41J 2/14; B41J 2/14024
See application file for complete search history.

(56) References Cited

U.S. PATENT DOCUMENTS 6,406,740 B1 * 6/2002 Komuro ..... B41J 2/1645 29/610.1
2009/0315955 A1 * 12/2009 Sakuma ..... B41J 2/1645 347/63

FOREIGN PATENT DOCUMENTS

JP 2001-138520 A 5/2001
JP 2012-125968 A 7/2012

* cited by examiner

*Primary Examiner* — Jannelle M Lebron
(74) *Attorney, Agent, or Firm* — Venable LLP

(57) ABSTRACT

A liquid ejection head includes a substrate; an energy generating member provided on the substrate to generate energy for liquid ejection; a terminal part provided on the substrate to be electrically connected with an outside, the terminal part including at least an electrode for supplying electric power to the energy generating member; a wiring layer provided on the substrate to electrically couple the energy generating member and the electrode; a nozzle member provided on the substrate, the nozzle member including a liquid ejection port and a liquid flow path, the liquid ejection port being arranged to correspond to the energy generating member, and the liquid flow path communicating with the liquid ejection port; and a metal structure provided to cover the wiring layer in a region where neither the nozzle member nor the electrode is provided, and the metal structure is electrically independent of the terminal part.

13 Claims, 9 Drawing Sheets

LIQUID EJECTION HEAD, METHOD OF MANUFACTURING THE SAME, AND LIQUID EJECTION APPARATUS

BACKGROUND OF THE INVENTION

Field of the Invention

The present invention relates to a liquid ejection head and a liquid ejection apparatus including the liquid ejection head.

Description of the Related Art

Japanese Patent Application Laid-Open No. 2001-138520, for example, discloses recovery processing for removing ink mist and the like adhered on a liquid ejection surface to clean the liquid ejection surface, by wiping the liquid ejection surface of a nozzle member of the liquid ejection head using a wiper such as a rubber blade. In recent years, the liquid ejection head ejects not only so-called ink containing a coloring material intended to be recorded on a paper medium but also, for example, metal ink and a reagent for device wiring and DNA diagnosis. The liquid material to be ejected is diversified in this manner, and it may be necessary to perform wiping with a stronger force (wiping by increasing the force applied in a direction perpendicular to the liquid ejection surface) than that in a case of ejecting ordinary ink. It is to be noted that the wiping may reach not only the nozzle member of the liquid ejection head but also a region around the nozzle member, for example, a circuit part.

On the other hand, Japanese Patent Application Laid-Open No. 2012-125968 discloses forming of an insulating layer made of silicon nitride on a wiring material for releasing static electricity from liquid ejection ports.

Regarding the wiring layer of the circuit part in which the nozzle member of the liquid ejection head is not provided, conventionally, particular protection against the wiping has not been provided. Hence, the wiring layer of the circuit part may be damaged by strong wiping. Japanese Patent Application Laid-Open No. 2012-125968 does not disclose at all the protection against the wiping for the wiring layer electrically coupling an energy generating member for liquid ejection and an electrode.

It is to be noted that Japanese Patent Application Laid-Open No. 2012-125968 discloses that the static electricity is guided from an ejection port to a resistance element so that the static electricity is converted by the resistance element into heat and is then consumed in order to prevent the static electricity from damaging the substrate after the static electricity enters from the ejection port and reaches the substrate under the ejection port. To guide the static electricity to the resistance element connected with a substrate grounding part, a metal film partially located around the ejection port and metal wiring in contact with a side wall of the nozzle member are used. These metal materials (the metal film and the metal wiring) are grounded, that is, not electrically independent of the outside, and form a circuit for releasing the static electricity. These metal materials are not protected, and damage caused by the strong wiping may impair a function as the circuit for releasing the static electricity.

An object of the present invention is to provide a liquid ejection head, a method of manufacturing the same, and a liquid ejection apparatus, by which a wiring layer of a circuit part can be protected with more certainty, even in a case where strong wiping is performed.

SUMMARY OF THE INVENTION

According to an aspect of the present invention, there is provided a liquid ejection head including

- a substrate,
- an energy generating member provided on the substrate to generate energy for liquid ejection,
- a terminal part provided on the substrate to be electrically connected with an outside, the terminal part including at least an electrode for supplying electric power to the energy generating member,
- a wiring layer provided on the substrate to electrically couple the energy generating member and the electrode,
- a nozzle member provided on the substrate, the nozzle member including a liquid ejection port, the liquid ejection port being arranged to correspond to the energy generating member, the liquid flow path communicating with the liquid ejection port, and
- a metal structure provided to cover the wiring layer in a region where neither the nozzle member nor the electrode is provided in the substrate, and the metal structure is electrically independent of the terminal part.

According to another aspect of the present invention, there is provided a liquid ejection apparatus including

- the liquid ejection head and
- a wiper configured to wipe a surface of the nozzle member on which the liquid ejection port is provided.

According to another aspect of the present invention,

- there is provided a method of manufacturing the liquid ejection head, the method including forming at least a part of the metal structure by plating.

Further features of the present invention will become apparent from the following description of exemplary embodiments with reference to the attached drawings.

DESCRIPTION OF THE EMBODIMENTS

Figure 1:
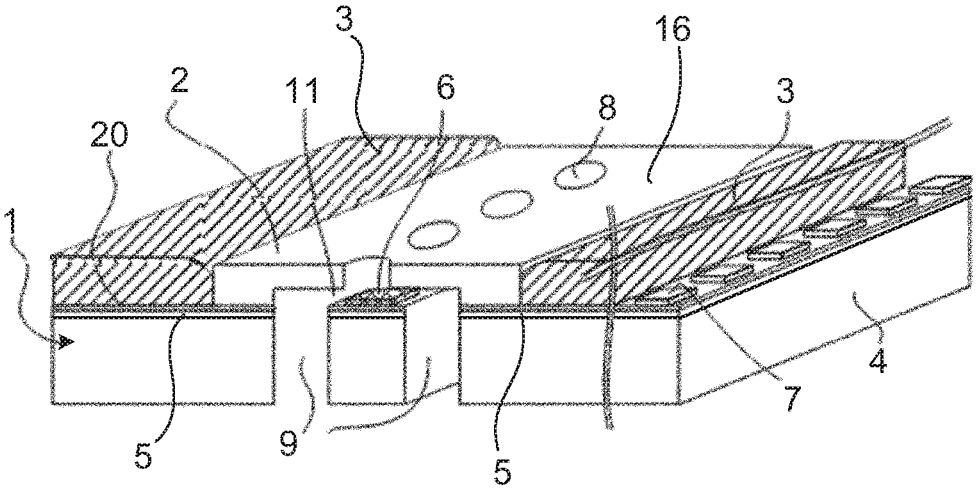
FIG. 1 is a schematic perspective view illustrating a liquid ejection head, which is partially cut out, according to a first embodiment.

Hereinafter, preferred embodiments of the present invention will be described below in detail with reference to the accompanying drawings. It is to be noted that in each figure, the same members are denoted by the same reference numerals, and overlapping descriptions are omitted.

First Embodiment

FIG. 1 is a schematic perspective view illustrating a liquid ejection head 1, which is partially cut out (which is cut out in line A-A of FIG. 6 to be described later), according to a first embodiment. The liquid ejection head 1 includes a substrate 4. Energy generating members 6 for generating energy for liquid ejection, electrodes 7 for supplying electric power to the energy generating members 6, a wiring layer 5 for electrically coupling the energy generating members 6 and the electrodes 7, and a nozzle member 2 are provided on the substrate. In the present embodiment, only the electrodes 7 for supplying the electric power to the energy generating members 6 are present as terminal parts to be electrically connected with the outside. However, in addition to the electrodes 7, for example, a grounding part for grounding a circuit on the substrate may be present. The nozzle member 2 includes liquid ejection ports 8 arranged to correspond to the energy generating members 6 and liquid flow paths 11, each communicating with the liquid ejection port 8. The upper surface of the nozzle member 2, on which the liquid ejection ports 8 are provided, is a liquid ejection surface 16. It is to be noted that the height of the nozzle member 2 (the distance from the substrate) is substantially constant.

A metal structure 3 is provided so as to cover the wiring layer 5 in a region where neither the nozzle member 2 nor the electrodes 7 is provided on the substrate 4 (particularly, on the surface side on which the nozzle member 2 and the wiring layer 5 are provided). The metal structure 3 is electrically independent of the terminal parts (the electrodes 7 in the present embodiment), and therefore is electrically independent of the wiring layer 5.

From the viewpoint of increasing the thickness of the metal structure 3 and facilitating the protection of the wiring layer 5 when wiping is performed, the maximum height of the metal structure 3 is preferably equal to or greater than the height of the nozzle member 2. In a region where a side wall of the nozzle member has been conventionally disposed, the metal structure 3 may be disposed instead of a part of the side wall of the nozzle member. For example, by partially replacing the part where the nozzle member (resin or the like) has been conventionally present with a metal that is harder than the nozzle member, the wiring layer 5 in the replaced part is protected with more certainty.

The metal structure 3 is typically adjacent to the nozzle member 2. This is to physically protect the wiring layer and to prevent a liquid such as ink from entering from a gap between the metal structure 3 and the nozzle member 2. However, as long as some type of structure (structure other than metal) for protecting the wiring layer 5 is interposed between the metal structure 3 and the nozzle member 2, the metal structure 3 and the nozzle member 2 do not necessarily have to be in contact with each other within a range satisfying the gist of the present invention.

From the viewpoint of preventing a wiper from being damaged by a corner of the metal structure 3 when the wiping is performed, the height of a contact boundary portion of the metal structure 3 in contact with the nozzle member 2 is preferably equal to or less than the height of the nozzle member 2.

In the liquid ejection head 1 illustrated in FIG. 1, the maximum height of the metal structure 3 exceeds the height of the nozzle member 2, and a contact end portion on the upper surface of the metal structure 3 in contact with the nozzle member 2 forms an inclined surface having an upward convex curvature. Specifically, the metal structure 3 includes a region higher in height than the nozzle member 2 (a flat region having the maximum height and parallel to the substrate) and a contact boundary portion in contact with the nozzle member 2 at a position lower than the height of the nozzle member 2. In addition, the inclined surface having a curvature is formed from the higher region toward a low-height boundary part. The shape in cross section of the inclined surface having such a curvature (cross section parallel to the thickness direction of the substrate 4 and parallel to the direction away from the nozzle member 2) is curved with a constant curvature radius or a changing curvature radius, that is a so-called rounded shape.

In the liquid ejection head 1 illustrated in FIG. 1, the height of the contact boundary portion of the metal structure 3 in contact with the nozzle member 2 is less than the height of the nozzle member 2. However, the nozzle member 2 and the metal structure 3 may be in contact with each other at the same height.

The configuration of the liquid ejection head according to the first embodiment will be described in more detail.

In the substrate 4 of the liquid ejection head 1, there are provided the wiring layer 5, the plurality of energy generating members 6 provided above the wiring layer 5, and the electrodes 7 provided above the wiring layer 5 for supplying the electric power to the energy generating members 6 through the wiring layer 5. The nozzle member 2 is provided above the wiring layer 5. An insulating layer 20 is provided on and in contact with the wiring layer 5. However, positions where electric connection is necessary (with the energy generating members 6 and with the electrodes 7) can be electrically connected through contacts provided as appropriate (not illustrated). Alternatively, the energy generating members 6 and the like may be directly formed on the wiring layer 5. The nozzle member 2 is provided with the plurality of liquid ejection ports 8 and the plurality of liquid flow paths 11, each communicating with each of the plurality of liquid ejection ports 8. The metal structure 3 is formed above the wiring layer 5 through the insulating layer 20 and is adjacent to the nozzle member 2. The metal structure 3 is electrically independent of the wiring layer 5 and the electrodes 7. Although not illustrated in FIG. 1, in a case where the terminal parts are present other than the electrodes, the metal structure 3 is also electrically independent of the terminal parts. The metal structure is used as a structure for protecting the wiring layer, and is different from a wiring layer forming an electric circuit.

The liquid ejection head 1 feeds liquid supplied from supply openings 9 to the liquid flow paths 11, and ejects the liquid from the liquid ejection ports 8 using the energy generating members 6. As illustrated in FIG. 1, the provision of a set (two) of supply openings 9 for one liquid ejection port enables ejection of the liquid while circulating the liquid in the liquid flow paths 11. In such a case, one of the supply openings 9 can be made to function as a liquid recovery opening.

Glass, quartz, ceramic, or silicon can be used as a material of the substrate 4. In particular, silicon is preferable because a plurality of fine etching holes, transistors, heaters, and the like can be formed in a substrate by a semiconductor process or micro electro mechanical systems (MEMS) technique.

The energy generating member 6 is, for example, an electrothermal conversion element (so-called heater). The pressure is applied to the liquid by the energy generating members 6, and the liquid is ejected from the liquid ejection ports 8.

Electric power is supplied to the energy generating members 6 from the wiring layer 5 provided on the substrate 4. Aluminum, gold, copper, tungsten, tantalum, titanium, chromium, and alloys thereof can be used as a material of the wiring layer 5.

The wiring layer 5 may be a single layer or a multilayer structure. In a case where the wiring layer is a multilayer structure, an interlayer insulating layer (not illustrated) for insulating the wiring layers can be provided. Silicon oxide or nitride can be used as a material of the interlayer insulating layer used for the wiring layer 5 having a multilayer structure and the insulating layer 20 provided on the wiring layer 5. The above insulating layers can be formed by any method such as chemical vapor deposition (CVD), atomic layer deposition (ALD), sputtering, thermal oxidation, vapor deposition, sol-gel, and the like. A barrier layer can be provided between the interlayer insulating layer and the wiring layer. Ti, TiN, TiW, or a silicon compound such as SiC, SiOC, SiCN, SiOCN, SiON, or the like can be used as a material of the barrier layer.

A protective film (not illustrated) resistant to the liquid to be ejected can be provided above the wiring layer 5 through the insulating layer 20. A silicon compound such as SiO, SiN, SiC, SiOC, SiCN, SiOCN, SiON, or the like can be used as a material of the protective film. The insulating layer 20 can also serve as the protective film.

The nozzle member 2 is provided with the supply openings 9 for ejecting the liquid to the liquid ejection ports 8. The supply openings 9 are formed by, for example, laser processing or etching. Any of wet etching and dry etching may be used for etching. In a case where a silicon substrate is wet etched, through holes (supply openings) perpendicular to the substrate surface can be formed by anisotropic etching using a potassium hydroxide or tetra-ammonium hydroxide aqueous solution with the use of a crystal orientation surface. Further, in a case where silicon is used for the substrate 4, reactive ion etching (RIE) among the dry etching techniques is suitable for forming a via having a high aspect ratio. Among the RIE techniques, Bosch process for alternately performing etching by $SF_6$ gas and side surface protective film deposition by $C_4F_8$ gas is suitable for forming the supply openings 9 having a high aspect ratio.

The material of the nozzle member 2 can be appropriately selected from those having resistance to the liquid to be ejected. For example, an epoxy resin, an acrylic resin, polyimide, polyamide, or a copolymer thereof can be used as an organic material. SiO, SiN, SiC, SiOC, SiCN, SiOCN, SiON, or the like can be used as an inorganic material.

In a case where the liquid is ejected in a thermal method, the height of the nozzle member 2 (particularly, the liquid ejection surface 16) is preferably 40 μm or less, more preferably 20 μm or less, and further preferably 10 μm or less, from the viewpoint of liquid-refilling performance after ejection and the like.

The metal structure 3 is provided above the wiring layer 5 through the insulating layer 20. Hence, the metal structure 3 is electrically independent of the wiring layer 5. Therefore, the metal structure 3 is also electrically independent of the electrodes 7, provided above the wiring layer 5, for supplying the electric power to the energy generating members 6 through the wiring layer 5. The metal structure 3 is preferably provided directly (for example, without the provision of an adhesive layer) above the wiring layer 5 through the insulating layer 20, from the viewpoint of suppressing destruction of the wiring layer 5 by wiping.

Nickel, copper, iron, titanium, tungsten, and alloys thereof can be used as a metal of the metal structure 3. In terms of rigidity, the metal structure 3 preferably contains nickel. In addition, the metal structure 3 may be formed of a plurality of layers having different compositions, and in such a case, each layer can have a function. For example, in a case where titanium is made to function as an adhesion layer to the insulating layer 20 and nickel having high rigidity is laminated on the adhesion layer, the adhesion of the metal structure 3 can be improved more than that in a case where the nickel layer is directly formed on the insulating layer 20. The metal structure 3 may be made of, but not limited to, pure metal. The metal structure 3 may contain oxygen, nitrogen, phosphorus, or sulfur, and may include fine particles of an inorganic compound or an organic compound. The surface of the metal structure 3 can be made water repellent by including, for example, particles (particularly, fine particles) made of a fluorine compound (particularly, a fluororesin). For example, the metal structure can include a metal layer containing a fluororesin.

According to the first embodiment, since the contact end portion of the metal structure 3 in contact with the nozzle member 2 has a rounded cross-sectional shape, the contact end portion abuts the wiper smoothly. Thus, scratch and breakage of the wiper can be suppressed. In addition, since the contact boundary portion of the metal structure 3 in contact with the nozzle member 2 is located to be lower than the liquid ejection surface 16 of the nozzle member 2, the wiper does not come into contact with a corner portion of the metal structure 3, and the breakage of the wiper can be suppressed also in this respect. It is to be noted that in the first embodiment, the contact boundary portion of the metal structure 3 in contact with the nozzle member 2 is located to be lower than the liquid ejection surface 16 of the nozzle member 2, but as described above, the contact boundary portion may be located at the same height with the height of the liquid ejection surface 16 of the nozzle member 2.

Furthermore, since the metal structure 3 according to the present embodiment is adjacent to the nozzle member 2, the wiring layer 5 provided with the insulating layer 20 is not exposed between the metal structure 3 and the nozzle member 2. Therefore, a load caused by wiping, paper jam or the like is prevented from being directly applied to the wiring layer 5 provided with the insulating layer 20. In addition, the wiped liquid can be prevented from staying in a gap between the metal structure 3 and the nozzle member 2.

The height of the metal structure 3 can be set appropriately at a height suitable for avoiding damage of the wiring layer 5, but is preferably equal to or greater than that of the nozzle member 2 as described above. From the viewpoint of suppressing degradation of printing quality due to an increase in distance between the liquid ejection ports 8 and a recording medium (so-called paper-to-paper distance) and from the viewpoint of facilitating the contact of the wiper with the liquid ejection surface 16, it is preferable that the height of the metal structure 3 does not largely exceed the height of the nozzle member 2. Therefore, the height (maximum height) of the metal structure 3 is preferably 40 μm or less, more preferably 20 μm or less, and further preferably 10 μm or less.

In a case where the height (maximum height) of the metal structure 3 is the same as the height of the nozzle member 2, the metal structure 3 does not protrude upward with respect to the nozzle member 2 even in a case where the metal structure 3 has a corner portion. Therefore, this is preferable because the damage of a wiper 10 caused by the corner portion of the metal structure 3 is avoided. In a case where the height of the contact end portion of the metal structure 3 in contact with the nozzle member 2 is reduced to have an inclined surface shape with a curvature approaching the nozzle member 2, the cross section of the metal structure 3 has roundness (particularly, a rounded shape). In such a configuration, even in a case where the metal structure 3 is partially higher than the nozzle member 2, a part of the metal structure 3 in contact with the nozzle member 2 is not a corner portion.

Further, in a case where the metal structure 3 includes a corner portion toward the nozzle member 2, the difference in height between the metal structure 3 and the nozzle member 2 (the height of the metal structure minus the height of the nozzle member 2) is preferably approximately 1 μm or less from the viewpoint of suppressing the wiper damage. In a case where the metal structure 3 has roundness toward the nozzle member 2, the above difference in height is preferably approximately 3 μm or less, for example, approximately 3 μm, from the viewpoint of facilitating wiping the nozzle member 2 close to the metal structure 3.

Figure 2:
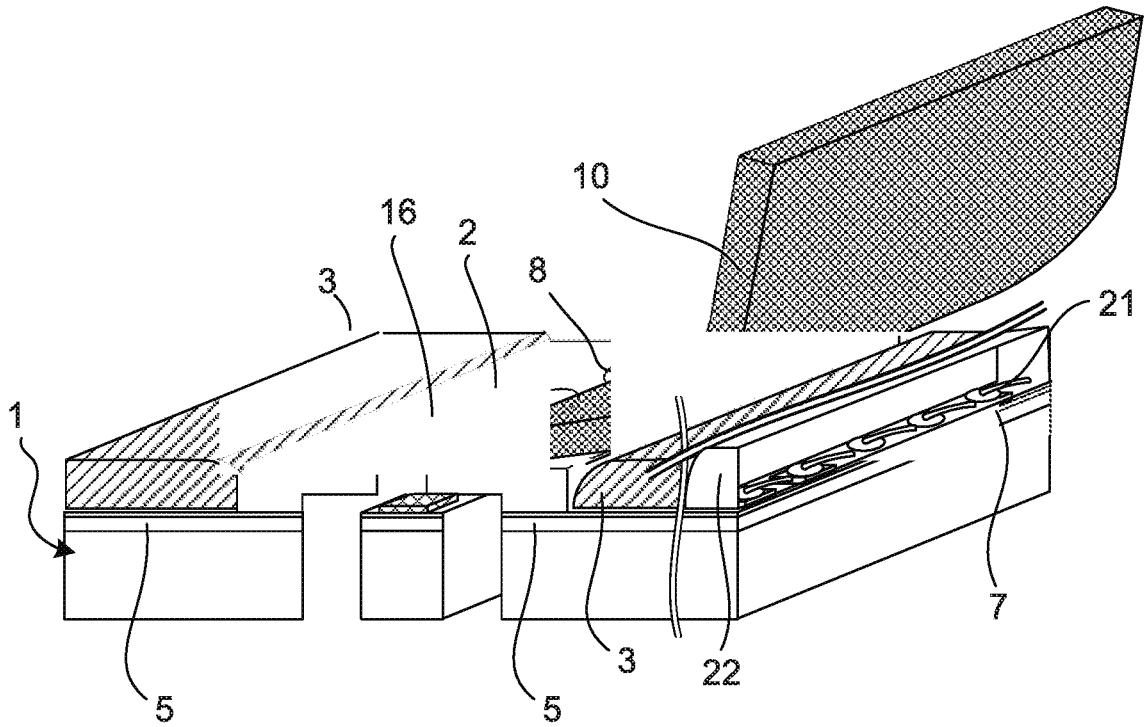
FIG. 2 is a schematic view for describing wiping in actual use of the liquid ejection head according to the first embodiment.

FIG. 2 illustrates a state of the liquid ejection head 1 according to the first embodiment, when wiping is performed. In this state, each of the electrodes 7 is electrically connected with the outside by one of wires 21, and the electrodes 7 are sealed with a sealing material 22 such as an epoxy resin. The wiper 10 moves in the right direction in FIG. 2, and wipes the liquid ejection surface 16. The contact end portion on the upper surface of the metal structure 3 in contact with the nozzle member 2 is made to have a rounded cross-sectional shape, and thus damage to the wiper 10 can be suppressed even in a case where the wiper 10 is pressed against the metal structure 3 by a strong force. The curvature radius of the rounded cross-sectional shape of the metal structure 3 in the present embodiment is not necessarily constant, and may be changed. The roundness (curvature radius) can be determined as appropriate.

The metal structure 3 can be produced by plating. In this case, the height of the metal structure 3 can be adjusted by stopping the growth of a plating layer at an appropriate timing. In addition, the shape of the contact end portion of the metal structure 3 in contact with the nozzle member 2 can be adjusted by adjusting the distance between a seed layer for plating and the nozzle member 2. For example, by bringing the seed layer and the nozzle member close to each other, the contact end portion of the metal structure becomes flat, that is, has a flat shape. On the other hand, by separating the seed layer and the nozzle member from each other, the rounded cross-sectional shape can be made as described above. In addition, the curvature of the cross section can be adjusted by the separation distance between the seed layer and the nozzle member.

Figure 6:
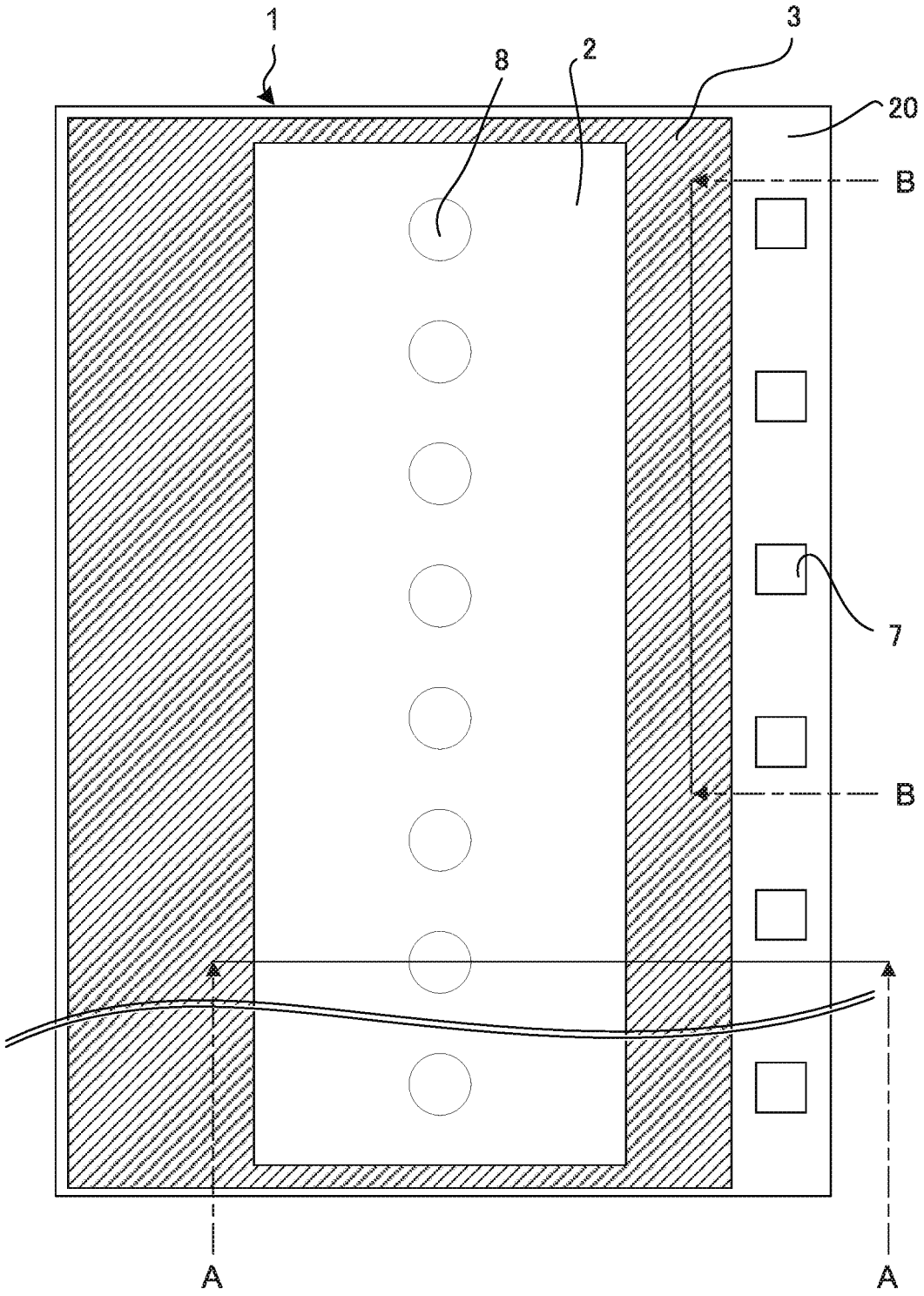
FIG. 6 is a schematic top view of the liquid ejection head according to the first embodiment.

FIG. 6 illustrates a schematic top view of the liquid ejection head 1 according to the present embodiment. The metal structure 3 is provided on the insulating layer 20. Although not illustrated in FIG. 6, the wiring layer is present under the insulating layer 20. The metal structure 3 is provided to be adjacent to the entire periphery of the nozzle member 2. The metal structure 3 is provided so as to cover the wiring layer in a region where neither the nozzle member 2 nor the electrodes 7 is provided. However, it is not necessary to cover the wiring layer entirely in the region where neither the nozzle member 2 nor the electrode 7 is provided. For example, for electrical independence of the electrodes 7, the metal structure 3 may be arranged to be spaced apart from the electrodes 7. In such a space, another member made of, for example, a resin, such as the sealing material 22 illustrated in FIG. 2 may be appropriately arranged.

It is to be noted that end portions (an uppermost end portion, a lowermost end portion, a leftmost end portion, and a rightmost end portion in FIG. 6) other than the contact end portions on the upper surface of the metal structure 3 in contact with the nozzle member 2 preferably form an inclined surface having an upward convex curvature. This is to reduce the possibility that the wiper is damaged by the above-described end portions. Further, the width of the metal structure depends on the nozzle layout and can take various values. For example, the width of the metal structure is 80 μm or more in the horizontal direction on the sheet of FIG. 6, particularly 80 mm or more, and 20 mm or more in the vertical direction on the sheet of FIG. 6.

Figure 9:
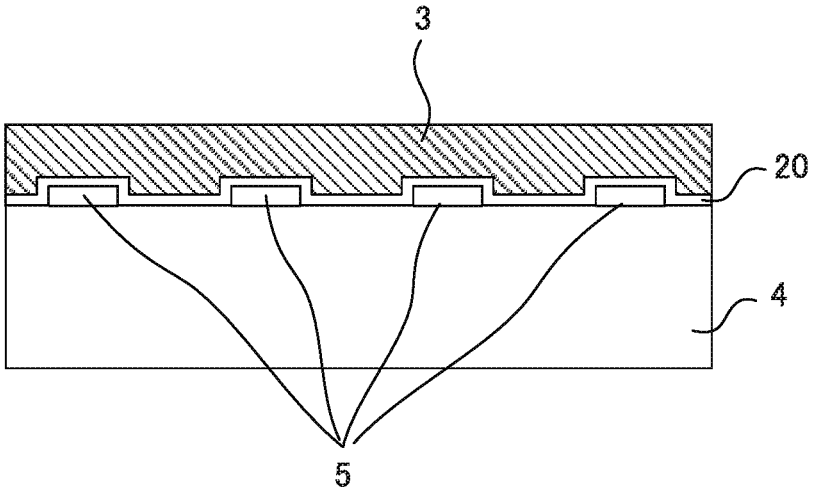
FIG. 9 is a schematic partial cross-sectional view of the liquid ejection head according to the first embodiment.

FIG. 9 is a schematic partial cross-sectional view (a cross-sectional view taken along line B-B of FIG. 6) of the liquid ejection head 1 according to the present embodiment. The metal structure 3 is provided over the plurality of wiring layers 5 via the insulating layer 20, and each of the plurality of wiring layers 5 is connected with each of the plurality of electrodes 7.

Second Embodiment

Figure 4:
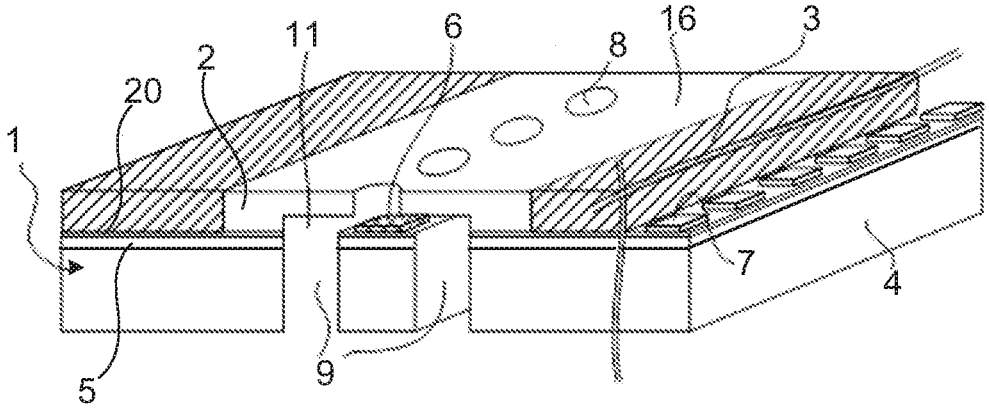
FIG. 4 is a schematic perspective view illustrating a liquid ejection head, which is partially cut out, according to a second embodiment.

A specific example of a liquid ejection head according to a second embodiment will be described with reference to FIG. 4. An upper surface of a metal structure 3 is flat, and therefore a contact end portion on the upper surface of the metal structure 3 in contact with a nozzle member 2 is flat (not an inclined surface having a curvature). In addition, the upper surface of the metal structure 3 and a liquid ejection surface 16 of the nozzle member 2 have the same height. That is, almost the entirety of the head surface (the upper surface of the metal structure 3 and the liquid ejection surface 16 of the nozzle member 2) has a flat structure. This point differs from the first embodiment.

The liquid ejection surface 16 of the nozzle member 2 is water repellent. Further, the surface of the metal structure 3 is composed of nickel phosphorus co-deposited with a fluorine compound (polytetrafluoroethylene: PTFE). Accordingly, the liquid ejection surface 16 and the surface of the metal structure 3, both exhibiting water repellency, constitute the liquid ejection head. The height of the metal structure 3 is equal to the height of the nozzle member 2. Hence, a corner portion of the metal structure 3 does not come into contact with a wiper, and the damage of the wiper is suppressed even in a case where wiping is performed with a strong force.

Other than the above point, the second embodiment may be the same as the first embodiment.

[Liquid Ejection Apparatus]

Figure 8:
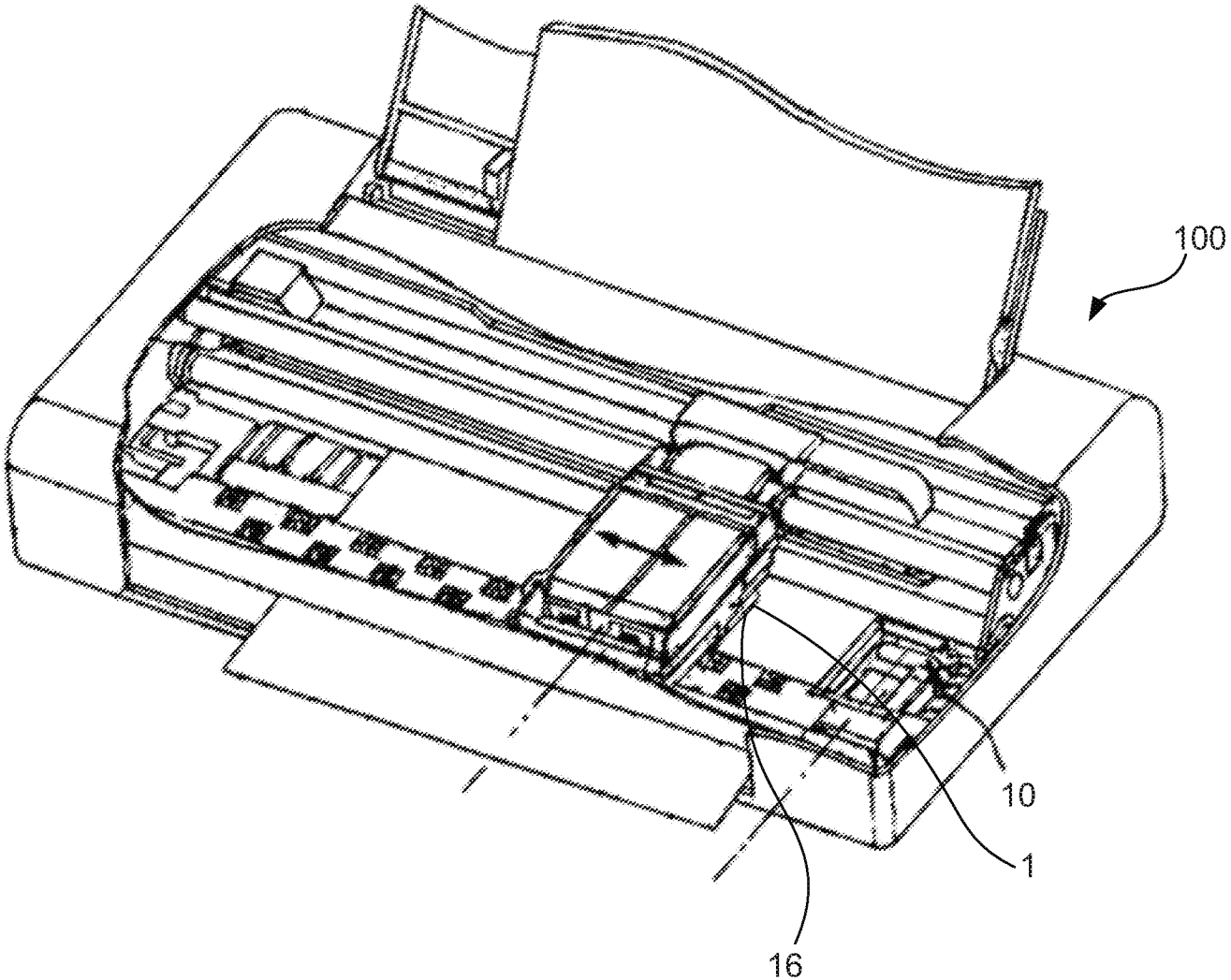
FIG. 8 is a perspective view illustrating an example of a liquid ejection apparatus.

FIG. 8 is a perspective view of an example of a liquid ejection apparatus 100, in which a liquid ejection head according to the present invention can be used. In recovery processing of the liquid ejection surface 16 of the liquid ejection head 1, the liquid ejection surface 16 is wiped by using the wiper 10 and the ink droplets and the like adhered on the liquid ejection surface 16 are removed and cleaned.

EXAMPLES

Hereinafter, the present invention will be described in more detail with specific examples.

First Example

The present example is a specific example of the liquid ejection head according to the first embodiment. As illustrated in FIG. 1, in the liquid ejection head 1, the nozzle member 2 made of an epoxy resin is provided with the liquid ejection ports 8 for ejecting a liquid supplied from the supply openings 9. The height of the nozzle member 2 is 10 μm. The energy generating member 6 is a heater. Electric signals and electric power are supplied from the electrodes 7 through the wiring layer 5, the liquid is heated and foamed, and the liquid is ejected from the liquid ejection ports 8.

The substrate 4 is a silicon substrate having a thickness of 625 μm, and is provided with the wiring layer 5 having five layers of alloy wiring of copper and aluminum. The wiring layer 5 has a thickness of approximately 8 μm, and a SiCN layer (insulating layer 20) having a thickness of 150 nm is provided on the upper surface of the uppermost layer of the metal wiring. The supply openings 9 for supplying the liquid to the liquid ejection ports 8 through the liquid flow paths 11 are provided in the substrate 4, the wiring layer 5, and the insulating layer 20.

The metal structure 3 is provided above the wiring layer 5 through the insulating layer 20 to be in contact with side surfaces of the nozzle member 2. The metal structure 3 is composed of three layers of titanium, nickel, and nickel phosphorus from the wiring layer 5 side. The height of the metal structure 3 is 12 μm except for a portion (a portion forming an inclined surface having a curvature) close to a side surface of the nozzle member 2, and the contact boundary portion in contact with the nozzle member 2 is 9 μm. The height of the metal structure 3 is reduced to form an inclined surface shape having a curvature as approaching the nozzle member 2, and the inclined surface having a curvature in the cross section (cross section parallel to the thickness direction of the substrate 4 and parallel to the direction away from the nozzle member 2) has a rounded shape with a radius of approximately 3 μm. The metal structure 3 is electrically independent of the wiring layer 5 and the electrodes 7.

A specific example of a method of manufacturing the liquid ejection head according to the first example will be described with reference to FIGS. 3A to 3D.

Figure 3A:
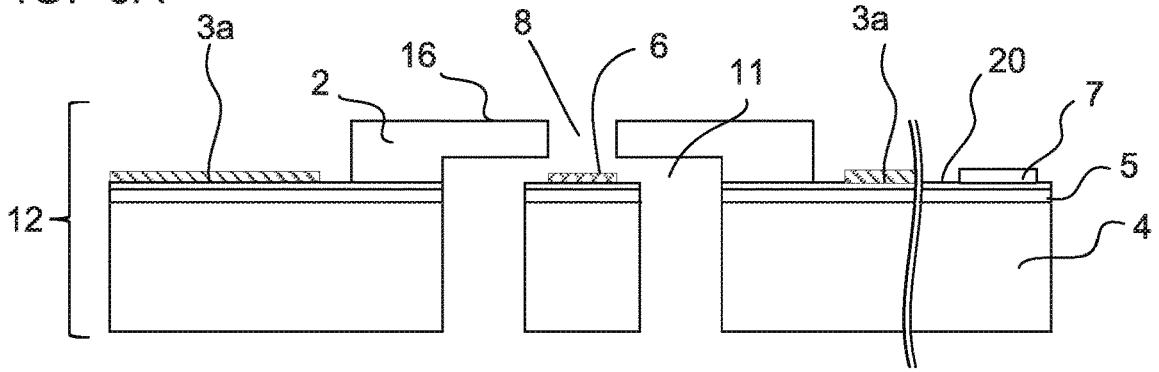
FIGS. 3A, 3B, 3C, and 3D are process diagrams illustrating a manufacturing process of the liquid ejection head according to a first example.

An element substrate 12 for liquid ejection illustrated in FIG. 3A is prepared. The element substrate 12 for liquid ejection is provided with the wiring layer 5 having five layers of alloy wiring of copper and aluminum on the silicon substrate 4 having a thickness of 625 μm. A SiCN layer as an insulating layer 20 is provided on the wiring layer 5. The nozzle member 2 made of an epoxy resin is provided with the liquid ejection ports 8 for ejecting the liquid supplied from the supply openings 9. The supply openings 9 for supplying the liquid to the liquid flow paths 11 are provided in the substrate 4, the wiring layer 5, and the insulating layer 20.

A seed layer 3*a* used for plating, to be described later, is provided on the insulating layer 20 at a position apart from the nozzle member 2 by 3 μm. Regarding the seed layer 3*a*, sequentially from the substrate side, a titanium layer and a nickel layer are formed respectively at thicknesses of 5 nm and 200 nm. In addition, the seed layer 3*a* is provided also apart from the electrodes 7.

Figure 3B:
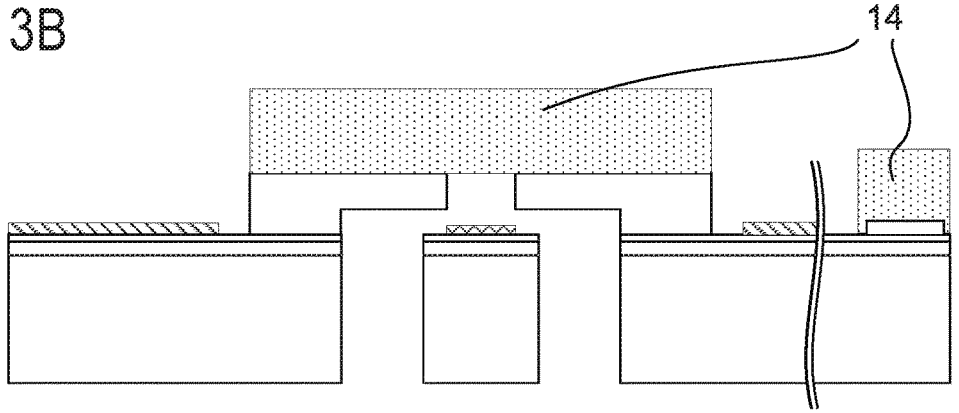

Next, as illustrated in FIG. 3B, a positive film resist is stuck on the element substrate 12 for liquid ejection, and a resist layer 14 that covers the liquid ejection surface 16 of the nozzle member 2 and the electrodes 7 are formed by exposure and development. It is to be noted that not only the upper surfaces of the electrodes 7 but also the side surfaces of the electrodes 7 are covered.

Figure 3C:
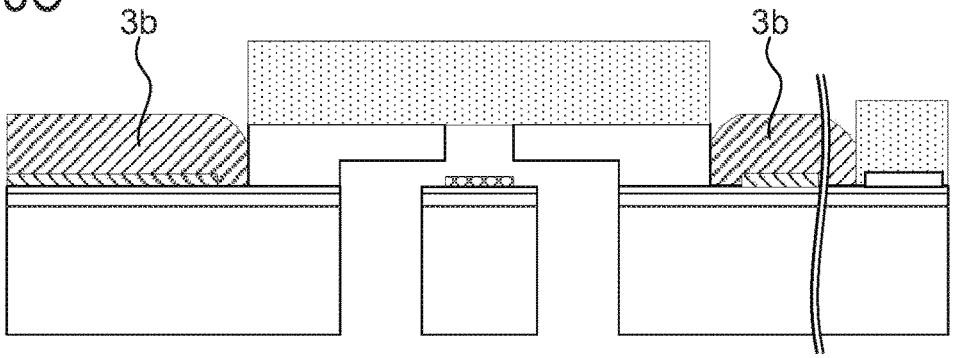

Next, as illustrated in FIG. 3C, when electroless plating is performed at 80° C. for 65 minutes by using an electroless nickel plating solution (product name: EPITHAS KSB, manufactured by C. Uyemura & Co., Ltd.), plating is deposited on the top surface of the seed layer 3*a* and grows almost isotropically, and a plating layer 3*b* is formed. The seed layer 3*a* and the plating layer 3*b* constitute the metal structure 3. The height of the metal structure 3 is 12 μm except for the portions close to the side surfaces of the nozzle member 2, and the height of the contact boundary portion is 9 μm. Since the seed layer 3*a* is apart from the nozzle member 2 by 3 μm, the height of the metal structure 3 is reduced to form an inclined surface shape having a curvature approaching the nozzle member 2, and the cross section of the contact end portion has a rounded shape with a radius of approximately 3 μm. The metal structure 3 is electrically independent of the wiring layer 5 and the electrodes 7.

Figure 3D:
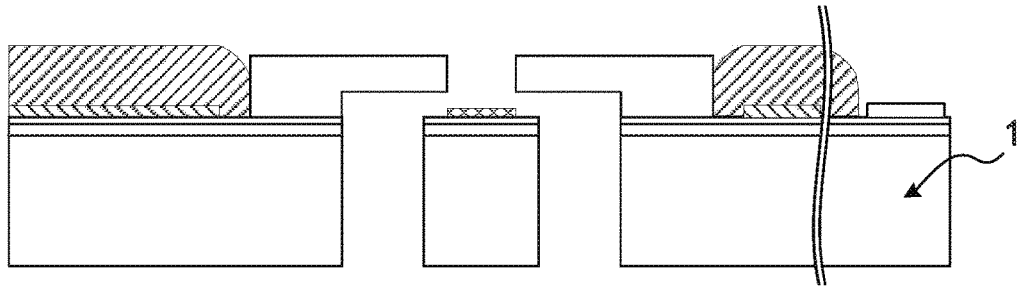

As illustrated in FIG. 3D, the resist layer 14 is removed by a remover, and then the liquid ejection head 1 in the first example is manufactured.

Second Example

The present example is a specific example of the liquid ejection head according to the second embodiment. As illustrated in FIG. 4, the point in which the height of the metal structure 3 is equal to that of the nozzle member 2 is different from the first example.

The liquid ejection surface 16 of the nozzle member 2 in the present example is a water repellent surface. In addition, the surface of the metal structure 3 is made of nickel phosphorus co-deposited with a fluorine compound (PTFE). The liquid ejection surface 16 and the surface of the metal structure 3 both exhibit water repellency. The height of the metal structure 3 is equal to the height of the nozzle member 2. Hence, a corner portion of the metal structure 3 does not come into contact with a wiper when wiping is performed, and the damage of the wiper is suppressed even when the wiping is performed with a strong force.

A specific example of a method of manufacturing the liquid ejection head illustrated in FIG. 4 will be described with reference to FIGS. 5A to 5D.

Figure 5A:
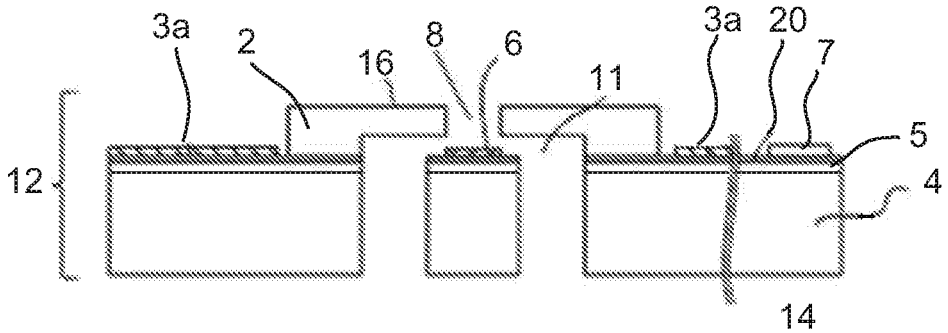
FIGS. 5A, 5B, 5C, and 5D are process diagrams illustrating a manufacturing process of the liquid ejection head according to a second example.

An element substrate 12 for liquid ejection illustrated in FIG. 5A is prepared. The element substrate 12 for liquid ejection in the present example is the same as that of the element substrate for liquid ejection in the first example except for the following points about the seed layer. The seed layer 3*a* is provided at a position apart from the nozzle member 2 by 1 μm. Regarding the seed layer 3*a*, sequentially from the substrate side, titanium and nickel are formed respectively at thicknesses of 5 nm and 200 nm. By bringing the seed layer 3*a* close to (or in contact with) the nozzle member 2 in this manner, the contact end portions of the metal structure 3 in contact with the nozzle surface 2 can be made into a flat surface not having a rounded cross-sectional shape.

Figure 5B:
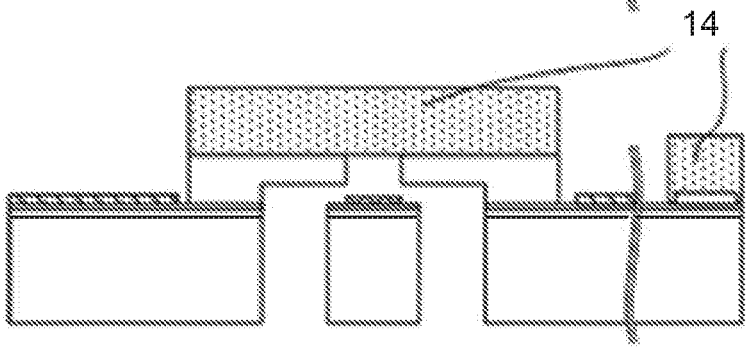

Next, as illustrated in FIG. 5B, a positive film resist is stuck on the element substrate 12 for liquid ejection, and a resist layer 14 that covers the liquid ejection surface 16 of the nozzle member 2 and the electrodes 7 is formed by exposure and development. It is to be noted that not only the upper surfaces of the electrodes 7 but also the side surfaces of the electrodes 7 are covered.

Figure 5C:
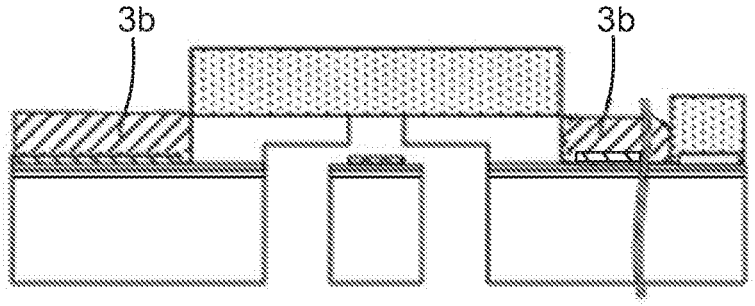

Next, as illustrated in FIG. 5C, when plating is performed at 80° C. for 65 minutes by using an electroless nickel PTFE composite plating solution (product name: NIMUFLON, manufactured by C. Uyemura & Co., Ltd.), plating is deposited on the top surface of the seed layer 3*a* and grows almost isotropically, and a plating layer 3*b* is formed. The seed layer 3*a* and the plating layer 3*b* constitute the metal structure 3. The upper surface of the metal structure 3 is flat, and the height is 10 μm and is the same as that of the nozzle member 2.

Figure 5D:
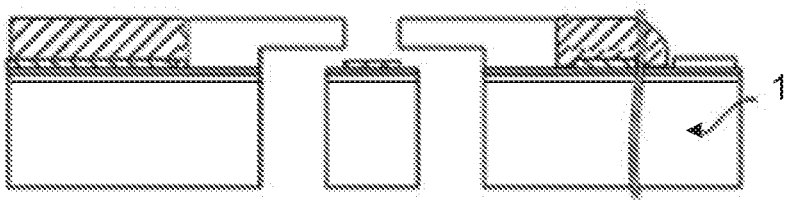

As illustrated in FIG. 5D, the resist layer 14 is removed by a remover, and then the liquid ejection head 1 in the second example is manufactured.

The cross-sectional shape of the metal structure 3 formed by plating can be adjusted by the distance between the seed layer 3*a* and the nozzle member 2. In a case where the distance is short, the cross-sectional shape becomes flat, and in a case where the distance is long, the cross-sectional shape has a shape that reaches the contact boundary portion with a curvature. The cross-sectional shape of the contact boundary portion in which the metal structure is brought into contact with the nozzle member can be freely adjusted depending on the desired characteristic.

[Fracture Toughness Test]

Liquid ejection heads with the metal structures 3 each having heights of 0.3 μm, 0.75 μm, and 1.5 μm were produced in the same manner as in the second example except that the plating time was changed. In addition, a liquid ejection head in which the insulating layer 20 provided on the wiring layer 5 was exposed (the height of the metal structure is 0 μm) was produced in the same manner as in the second example except that the metal structure 3 was not provided. By using the above liquid ejection heads, fracture toughness tests of the wiring layer 5 were performed.

Figure 7:
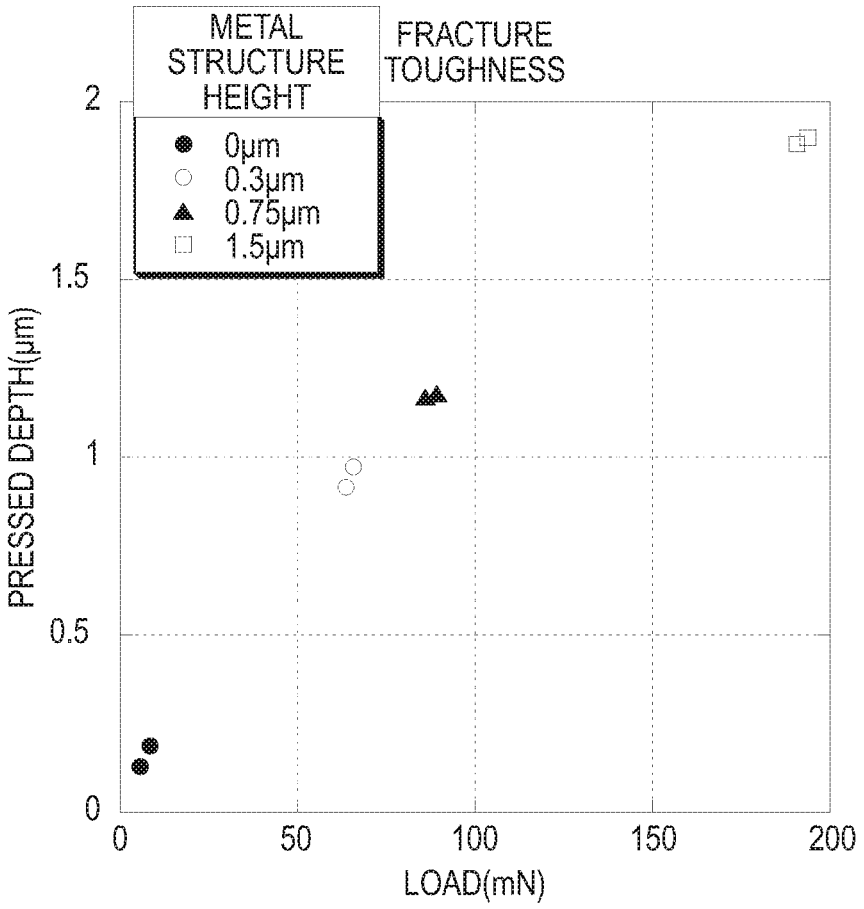
FIG. 7 is a graph illustrating fracture toughness test results of a wiring layer.

A load was applied to the metal structure 3 using a Nanoindenter (manufactured by Fischer Instruments K.K.) of a diamond indenter having a regular square pyramid with a facing angle θ=136°, so that the fracture toughness tests of the wiring layer 5 were performed. FIG. 7 illustrates the results. It is to be noted that the same tests were performed twice for each sample.

The graph of FIG. 7 was obtained by plotting numerical values to be start points of a bending part of a load displacement curve caused by a crack that occurred in the wiring layer 5, in a load displacement curve. It is to be noted that when the metal structure 3 was removed after the generation of the bending part, a crack was found in the wiring layer 5. Therefore, it can be said that the crack occurred at the generation of the bending part. The graph illustrates that the brittle fracture strength of the wiring layer 5 is larger with respect to the load, as the numerical value on the horizontal axis is plotted in a large region. It can be found in the graph that the brittle fracture strength is improved by providing the metal structure 3 above the wiring layer 5. Even in a case where wiping is performed with a strong force, the wiring layer 5 is hardly damaged because the brittle fracture strength is improved, and therefore the liquid ejection head 1 maintaining high-quality recording performance is obtained.

As described heretofore, by adopting the present invention, there are provided a liquid ejection head, a method of manufacturing the same, and a liquid ejection apparatus, by which a wiring layer of a circuit part can be protected with more certainty, even in a case where strong wiping is performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-169002, filed Sep. 18, 2019, which is hereby incorporated by reference herein in its entirety.

What is claimed is:

1. A liquid ejection head comprising:

a substrate;

an energy generating member provided on the substrate to generate energy for liquid ejection;

a terminal part provided on the substrate to be electrically connected with an outside, the terminal part including at least an electrode for supplying electric power to the energy generating member;

a wiring layer provided on the substrate to electrically couple the energy generating member and the electrode;

a nozzle member provided on the substrate, the nozzle member including a liquid ejection port and a liquid flow path, the liquid ejection port being arranged to correspond to the energy generating member, the liquid flow path communicating with the liquid ejection port; and a metal structure provided to cover the wiring layer in a region where neither the nozzle member nor the electrode is provided, wherein the metal structure is electrically independent of the terminal part, and wherein a maximum height of the metal structure is equal to or greater than a height of the nozzle member.

2. The liquid ejection head according to claim 1, wherein the metal structure is adjacent to the nozzle member.

3. The liquid ejection head according to claim 2, wherein a height of a contact boundary portion of the metal structure in contact with the nozzle member is equal to or less than a height of the nozzle member.

4. The liquid ejection head according to claim 3, wherein the maximum height of the metal structure exceeds a height of the nozzle member, and a contact end portion on an upper surface of the metal structure in contact with the nozzle member has an inclined surface with an upward convex curvature.

5. The liquid ejection head according to claim 4, wherein in a cross-section parallel to a thickness direction of the substrate and parallel to a direction away from the nozzle member, a shape of the inclined surface with the curvature is curved with either a constant curvature radius or a changing curvature radius.

6. The liquid ejection head according to claim 3, wherein a maximum height of the metal structure is equal to the height of the nozzle member, and a contact end portion on an upper surface of the metal structure in contact with the nozzle member either has an inclined surface with an upward convex curvature or is flat.

7. The liquid ejection head according to claim 6, wherein the contact end portion on the upper surface of the metal structure in contact with the nozzle member has the inclined surface with an upward convex curvature, and in a cross-section parallel to a thickness direction of the substrate and parallel to a direction away from the nozzle member, a shape of the inclined surface with the curvature is curved with either a constant curvature radius or a changing curvature radius.

8. The liquid ejection head according to claim 6, wherein the contact end portion on the upper surface of the metal structure in contact with the nozzle member is flat, and a height of the metal structure is constant from the contact boundary portion to a part having the maximum height.

9. The liquid ejection head according to claim 1, wherein the metal structure includes a plurality of layers with different compositions.

10. The liquid ejection head according to claim 1, wherein the metal structure includes a metal layer containing a fluororesin.

11. The liquid ejection head according to claim 1, wherein the metal structure contains nickel.

12. A liquid ejection apparatus comprising:

the liquid ejection head of claim 1; and a wiper configured to wipe a surface of the nozzle member on which the liquid ejection port is provided.

13. A method of manufacturing the liquid ejection head of claim 1, the method comprising forming at least a part of the metal structure by plating.

* * * * *